US007823545B2

(12) United States Patent
Arvan et al.

(10) Patent No.: US 7,823,545 B2
(45) Date of Patent: Nov. 2, 2010

(54) PISTON SQUIRTER SYSTEM AND METHOD

(75) Inventors: Gary J. Arvan, Rochester Hills, MI (US); Edward R. Romblom, De Witt, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/109,602

(22) Filed: Apr. 25, 2008

(65) Prior Publication Data

US 2009/0044768 A1 Feb. 19, 2009

Related U.S. Application Data

(60) Provisional application No. 60/956,446, filed on Aug. 17, 2007.

(51) Int. Cl.
*F01P 1/04* (2006.01)

(52) U.S. Cl. ..... 123/41.35; 184/6.8; 123/196 S; 123/196 R

(58) Field of Classification Search ..... 123/41.31, 123/41.35, 41.36, 41.37, 41.38, 41.39, 196 S, 123/196 R; 310/54, 52
See application file for complete search history.

(56) References Cited

U.S. PATENT DOCUMENTS

| | | | | |
|---|---|---|---|---|
| 4,204,487 | A * | 5/1980 | Jones | 123/41.35 |
| 4,364,351 | A | 12/1982 | Romblom et al. | |
| 4,387,693 | A | 6/1983 | Romblom | |
| 4,399,799 | A | 8/1983 | Romblom et al. | |
| 4,428,354 | A | 1/1984 | Sundeen et al. | |
| 4,448,066 | A | 5/1984 | Romblom et al. | |
| 5,503,116 | A * | 4/1996 | Wolf | 123/41.35 |
| 5,667,045 | A | 9/1997 | Cummings, III | |
| 5,855,266 | A | 1/1999 | Cummings, III | |
| 5,937,979 | A | 8/1999 | Cummings | |
| 5,947,247 | A | 9/1999 | Cummings, III | |
| 6,250,275 | B1 * | 6/2001 | Bock et al. | 123/196 R |
| 6,289,855 | B1 | 9/2001 | Romblom et al. | |
| 6,659,744 | B1 | 12/2003 | Raymond, Jr. | |
| 6,742,481 | B2 | 6/2004 | Baldwin | |
| 6,763,797 | B1 | 7/2004 | Staley et al. | |
| 6,789,517 | B2 | 9/2004 | Romblom et al. | |
| 6,866,011 | B1 | 3/2005 | Beardmore | |

(Continued)

FOREIGN PATENT DOCUMENTS

WO WO2007042067 * 4/2007

OTHER PUBLICATIONS

"Positive Displacement Pumps," The Engineering Tool Box, www.EngineeringToolBox.com, last visited Aug. 9, 2007.

*Primary Examiner*—Michael Cuff
*Assistant Examiner*—Hung Q Nguyen
(74) *Attorney, Agent, or Firm*—Quinn Law Group, PLLC

(57) ABSTRACT

A piston squirter system for an internal combustion engine includes an oil reservoir, a variable displacement pump, and, for each cylinder, a piston squirter that sprays oil onto a piston for cooling and lubricating. A gallery connects the variable displacement pump to the piston squirters. The variable displacement pump receives oil from the oil reservoir and distributes the oil through the gallery to the piston squirters at a flow rate according to pressure required. The gallery does not require a relief valve and the piston squirters do not require check valves.

5 Claims, 2 Drawing Sheets

U.S. PATENT DOCUMENTS

| | | | | |
|---|---|---|---|---|
| 6,955,142 | B2 | 10/2005 | Patel et al. | |
| 7,347,169 | B2 * | 3/2008 | Nagahashi et al. | 123/41.35 |
| 2003/0094150 | A1 | 5/2003 | Romblom et al. | |
| 2003/0230274 | A1 * | 12/2003 | Williams et al. | 123/196 R |
| 2004/0031463 | A1 * | 2/2004 | Williams et al. | 123/196 S |
| 2005/0081802 | A1 * | 4/2005 | Bontaz et al. | 123/41.35 |
| 2005/0098138 | A1 | 5/2005 | Sanders | |
| 2005/0232785 | A1 * | 10/2005 | Scholl | 417/220 |
| 2007/0056281 | A1 | 3/2007 | Arvan et al. | |
| 2007/0056543 | A1 | 3/2007 | Romblom | |

* cited by examiner

PISTON SQUIRTER SYSTEM AND METHOD

CROSS REFERENCE TO RELATED APPLICATION

This application claims the benefit of U.S. Provisional Patent Application No. 60/956,446, filed Aug. 17, 2007, and which is hereby incorporated by reference in its entirety.

TECHNICAL FIELD

The present invention relates to a piston squirter system for an internal combustion engine with at least one cylinder. The system employs a variable displacement pump to distribute oil from a reservoir to a gallery or galleries, which then disperse the oil to at least one squirter that sprays the oil onto a piston.

BACKGROUND OF THE INVENTION

Engine oil systems may use piston squirters, sometimes called cooling jets, to provide jets of oil to cool and/or lubricate pistons. Most of the known systems use fixed displacement oil pumps to deliver the oil from an oil pan through a gallery or galleries to the piston squirters. The flow rate of a fixed displacement oil pump depends upon the speed the pump is turned, thus requiring that the piston squirters, or gallery or galleries, be equipped with check valves to regulate oil flow at low engine speeds to maintain oil pressure, and that the gallery or galleries be equipped with a relief valve for dumping excess oil back into the oil pan at high engine speed. For instance, most high-output diesel engines require the use of piston cooling jets that squirt oil on the underside of the pistons and provide cooling. Because of the limited supply of oil at low engine speeds, such engines use a valve to stop the flow of oil when oil pressure is below a predetermined level. To date, no known system has been developed to eliminate such valves from the piston squirters while providing efficient oil supply.

SUMMARY OF THE INVENTION

A piston squirter system for an internal combustion engine is provided. The goal is to provide sufficient oil flow to pistons at low engine speed. The piston squirter system employs a variable displacement oil pump in combination with piston squirters without check valves. The system allows higher efficiency with cooling and lubricating jets that are always flowing. Continuous oil flow at varying rates of flow may reduce engine idle noise, flow restriction, vibration, and harshness (NVH) and improve engine durability. This oil flow may not be as practical in an engine with a fixed displacement pump due to high parasitic load required to maintain oil pressure at low engine speed, which may lead to reduced fuel economy. A potential benefit of eliminating check valves from the piston squirters is the ability to maintain adequate piston cooling by providing oil flow during extended duty cycles, from high engine load and speed to low engine load and idle operating conditions. Cost and size reductions of the internal combustion engine may also be realized from an accompanying reduction in part count.

The piston squirter system includes an oil reservoir, a variable displacement pump, and, for each cylinder, a piston squirter that sprays oil onto a piston for cooling and lubricating. A gallery connects the variable displacement pump to the piston squirters. In one aspect of the invention, the piston squirter is characterized by the absence of a check valve. In another aspect, the gallery is characterized by the absence of a relief valve. In another aspect, neither the piston squirter nor the gallery requires a check or relief valve. The piston squirter system can be used in a compression-ignited or spark-ignited internal combustion engine.

A method of pumping oil to a piston squirter in an internal combustion engine is also provided. The method operates in a piston squirter system of an internal combustion engine and includes pumping sufficient oil for spraying pistons in the absence of valves that respond to oil pressure. The method is operable substantially irrespective of low engine speed and is also operable with a variable displacement pump.

The above features and advantages and other features and advantages of the present invention are readily apparent from the following detailed description of the best modes for carrying out the invention when taken in connection with the accompanying drawings.

DESCRIPTION OF THE PREFERRED EMBODIMENT

Figure 1:
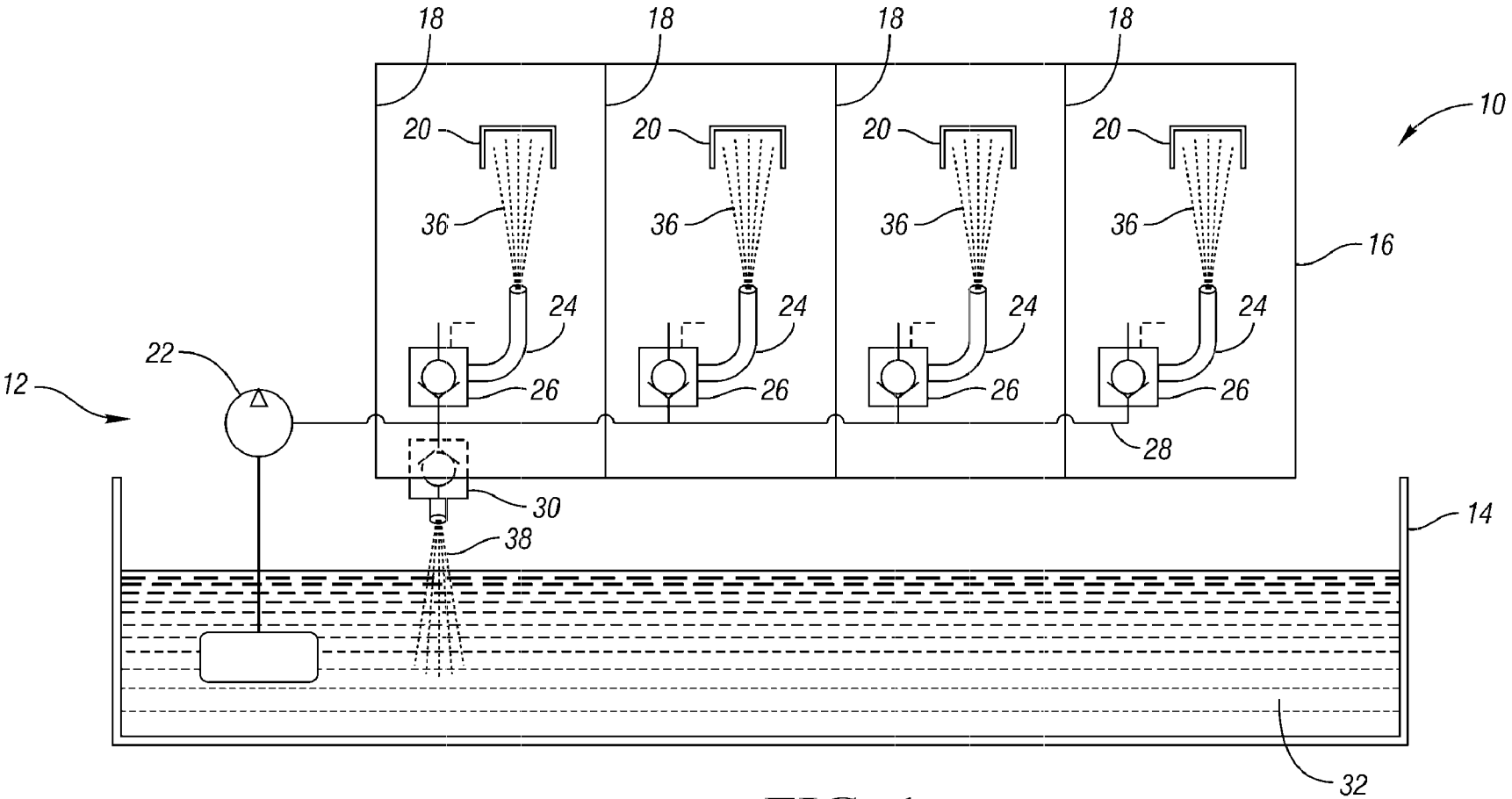
FIG. 1 (Prior Art)
FIG. 1 depicts a schematic illustration of an internal combustion engine having a conventional piston squirter system known to those of ordinary skill in the art.

FIG. 1, provided for comparison, depicts an internal combustion engine, generally indicated at 10, having a piston squirter system 12, known to those of ordinary skill in the art. The internal combustion engine 10 may be a compression-ignited or spark-ignited internal combustion engine. The internal combustion engine 10 includes an oil pan 14 mounted to an engine block 16 that defines a plurality of cylinders 18. Each of the plurality of cylinders 18 has a reciprocally movable piston 20 disposed therein. The piston squirter system 12 of FIG. 1 includes a fixed displacement pump 22 and piston squirters 24 with check valves 26. A gallery 28 is defined by the engine block 16 and is in communication with a relief valve 30. The gallery 28 connects the fixed displacement pump 22 to the piston squirters 24.

In the piston squirter system 12 of FIG. 1, the fixed displacement pump 22 receives oil 32 from the oil pan 14 and distributes the oil 32, under pressure, to the piston squirters 24 at a flow rate based on a speed of the fixed displacement pump 22. The piston squirters 24 deliver the pressurized oil in oil jets 36 to the plurality of cylinders 18 of the engine block 16 for cooling and lubricating of each reciprocally movable piston 20. Because the flow rate of the fixed displacement pump 22 does not vary with discharge pressure, the piston squirters 24 have check valves 26 that respond to pressure and thus regulate oil flow. Additionally, the gallery 28 has a relief valve 30 to regulate pressure within the gallery 28 and allow excess oil 38 to exhaust to the oil pan 14.

Figure 2:
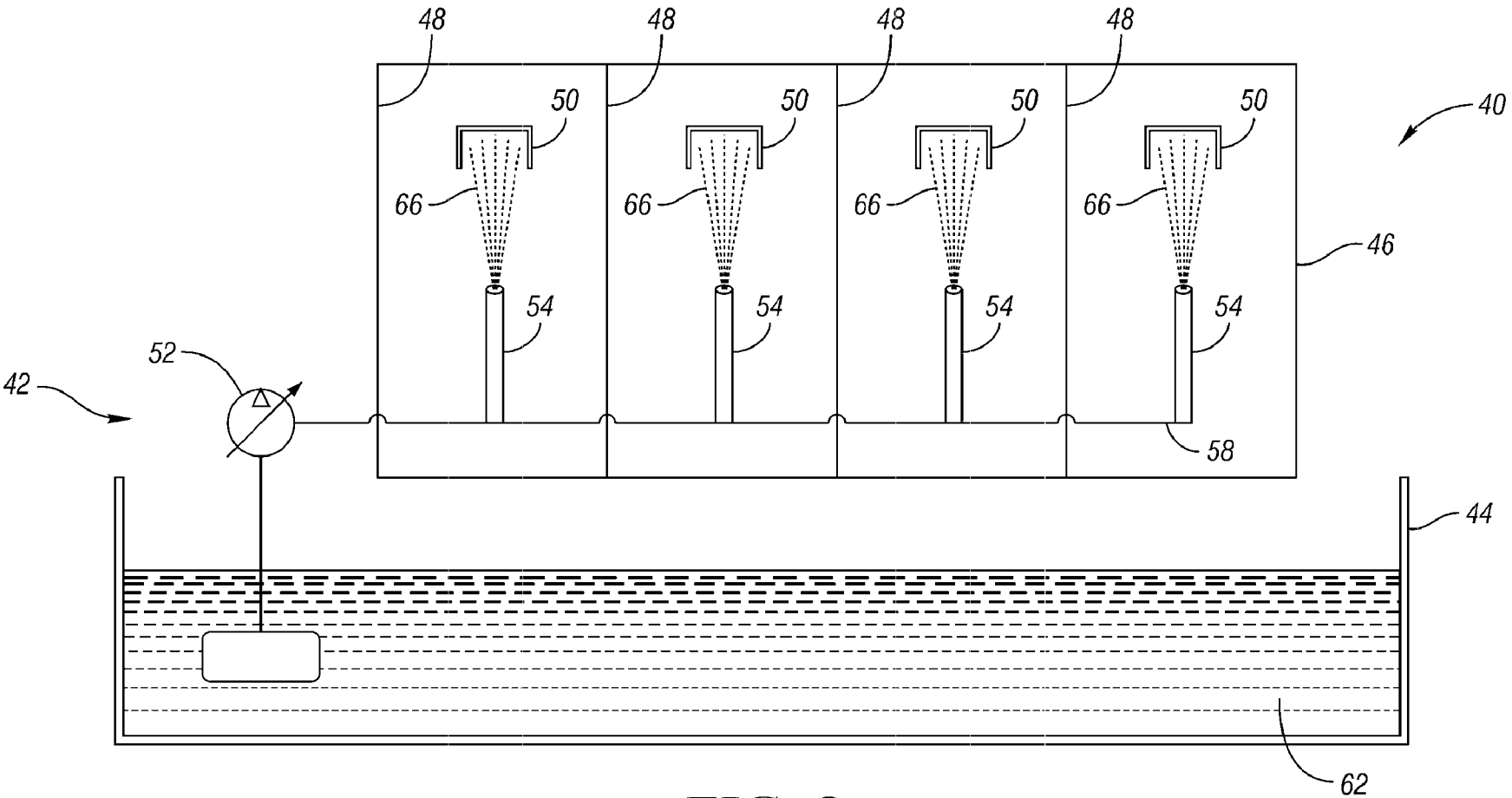
FIG. 2 depicts a schematic illustration of an internal combustion engine having a piston squirter system according to the present invention.

Referring to FIG. 2, an internal combustion engine, generally indicated at 40, includes a piston squirter system 42. The internal combustion engine 40 may be a compression-ignited or spark-ignited internal combustion engine. The internal combustion engine 40 includes an oil pan 44 removably mounted to an engine block 46 that defines a plurality of cylinders 48. Each of the plurality of cylinders 48 has a reciprocally movable piston 50 disposed therein. The piston squirter system 42 includes a variable displacement oil pump 52 and piston squirters or cooling jets 54. Depending on the embodiment, the variable displacement oil pump 52 may include, but is not limited to, vane and gerotor pumps. A gallery 58 is defined by the engine block 46 and is in communication with the variable displacement pump 52 and each of the piston squirters 54. Both systems of FIGS. 1 and 2 would typically contain an oil filter, not shown, to insure clean oil to the engine.

In the embodiment shown, the piston squirters 54 are characterized by the absence of check valves, such as the check valves 26 shown in FIG. 1. The variable displacement pump 52 is a pressure-regulation device in which the output volume varies according to pressure. Such variance is in accordance with engine speed so that each squirter is supplied with a quantity of oil sufficient to cool and/or lubricate its respective piston, and irrespective of engine speed. This is accomplished by increasing displacement under conditions such as hot idle and reducing displacement at higher engine speeds where oil flow and pressure are greater. The variable displacement pump 52 can be sized with higher volume output at low engine speeds, thereby allowing the removal of the check valves in the piston squirters 54 or in the circuit leading to the respective piston squirter 54. Moreover, the gallery 58 for the variable displacement pump 52 is characterized by the absence of a relief valve, such as the relief valve 30 shown in FIG. 1, as the quantity of oil needed to cool or lubricate a respective piston is controlled by the variable capacity of the variable displacement pump 52.

The variable displacement pump 52 receives oil 62 from an oil sump of an oil pan 44, pressurizes the oil 62, and pumps the pressurized oil through the gallery 58 to the piston squirters 54. The piston squirters 54 release the pressurized oil in oil jets 66 to the underside of the respective pistons in the plurality of cylinders 48 of the engine block 46 for lubricating and cooling of each reciprocally movable piston 50. Because the piston squirters 54 have no check valves for restricting oil flow, the pressurized oil may flow continuously through the piston squirter system 42. Oil pressure is controlled by the variable displacement pump 52, which may be sized to provide higher volume output at low engine speeds than is provided at high engine speeds, as described above.

This invention also includes a method of pumping oil to a piston squirter in an internal combustion engine operable at low to high speeds. Pump 52 pumps sufficient oil 62 from the reservoir or oil sump of the oil pan 44 to the piston squirters 54 for spraying each reciprocally movable piston 50. Pumping oil is provided by a variable displacement pump 52. Thus, the piston squirter method of this invention operates in the absence of check valves or relief valves and at engine speeds that vary from low to high, and irrespective of low engine speed such as hot idle.

While the best modes for carrying out the invention have been described in detail, those familiar with the art to which this invention relates will recognize various alternative designs and embodiments for practicing the invention within the scope of the appended claims.

The invention claimed is:

1. A piston squirter system for a compression-ignited internal combustion engine having an engine block defining at least one cylinder having a piston, the piston squirter system comprising:

a reservoir containing oil;

a variable displacement pump in fluid communication with the reservoir and at least one gallery, the variable displacement pump being operable to variably communicate the oil to the at least one gallery, thereby allowing an absence of valves in the at least one gallery; and at least one piston squirter in fluid communication with the at least one gallery and operable to spray the oil toward the piston into the at least one cylinder of the compression-ignited internal combustion engine;

wherein the at least one gallery is characterized by the absence of valves.

2. The piston squirter system of claim 1, wherein the piston squirter is characterized by the absence of valves.

3. A piston squirter system for a compression-ignited internal combustion engine having an engine block defining at least one cylinder having a piston, the piston squirter system comprising:

a reservoir containing oil;

a variable displacement pump in fluid communication with the reservoir and at least one gallery, and operable to variably communicate the oil to the at least one gallery, thereby allowing an absence of valves in the at least one gallery, the at least one gallery being characterized by the absence of valves; and at least one piston squirter in fluid communication with the at least one gallery and operable to spray the oil onto the piston of the compression-ignited internal combustion engine, the at least one piston squirter being characterized by the absence of valves.

4. A method of pumping oil to a piston squirter in a compression-ignited internal combustion engine operable at low to high speeds and having an oil reservoir and an engine block defining at least one cylinder having a piston disposed therein, the method comprising:

pumping a sufficient quantity of oil from the reservoir to the piston squirter at a sufficient oil pressure for spraying the piston of the compression-ignited internal combustion engine in the absence of valves responsive to the sufficient oil pressure and substantially irrespective of engine speed.

5. The method of claim 4 wherein pumping the sufficient quantity of oil from the reservoir to the piston squirter is provided by a variable displacement pump.

* * * * *